US007589679B2

(12) United States Patent
Shih

(10) Patent No.: US 7,589,679 B2
(45) Date of Patent: Sep. 15, 2009

(54) ANTENNA DEVICE

(75) Inventor: Yen-Yi Shih, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 222 days.

(21) Appl. No.: 11/615,949

(22) Filed: Dec. 23, 2006

(65) Prior Publication Data

US 2008/0036666 A1 Feb. 14, 2008

(30) Foreign Application Priority Data

Aug. 11, 2006 (TW) ..... 95129620 A

(51) Int. Cl.
*H01Q 1/24* (2006.01)

(52) U.S. Cl. ..... 343/702; 343/700 MS

(58) Field of Classification Search ..... 343/702, 343/700 NS, 846
See application file for complete search history.

(56) References Cited

U.S. PATENT DOCUMENTS

| | | | | |
|---|---|---|---|---|
| 6,549,167 | B1 * | 4/2003 | Yoon | 343/700 MS |
| 6,664,931 | B1 * | 12/2003 | Nguyen et al. | 343/767 |
| 6,965,346 | B2 | 11/2005 | Sung et al. | |
| 6,995,710 | B2 * | 2/2006 | Sugimoto et al. | 343/700 MS |
| 7,319,431 | B2 * | 1/2008 | Jeon et al. | 343/700 MS |
| 7,385,463 | B2 * | 6/2008 | Koga et al. | 333/133 |
| 2002/0075190 | A1 * | 6/2002 | Ghosh et al. | 343/702 |
| 2007/0040749 | A1 | 2/2007 | Jeon et al. | |

FOREIGN PATENT DOCUMENTS

| | | |
|---|---|---|
| TW | 456068 | 9/2001 |
| TW | 531936 | 5/2003 |
| TW | 570318 | 1/2004 |
| TW | I255073 | 5/2006 |
| TW | M292175 | 6/2006 |

* cited by examiner

*Primary Examiner*—HoangAnh T Le
(74) *Attorney, Agent, or Firm*—Wei Te Chung

(57) ABSTRACT

An antenna device (10) is disposed on a substrate (30), and includes a feed part (14), a holder (20), a body part (18), at least one ground plane (11), and a matching part (16). The feed part is for feeding electromagnetic signals. The body part for radiating and receiving the electromagnetic signals is electronically connected to the feed part. The body part includes at least two radiation parts electronically connected in sequence and disposed on at least two adjacent surfaces of the holder. The at least one ground plane for grounding is disposed on one side of the substrate. The matching part for impendence matching includes one end electronically connected to the body part and another end electronically connected to the ground plane. The ground plane surrounds two adjacent sides of the matching part.

17 Claims, 7 Drawing Sheets

ANTENNA DEVICE

BACKGROUND OF THE INVENTION

1. Field of the Invention

The present invention relates to antenna devices, and particularly to an antenna device in a wireless local area network (WLAN) device.

2. Description of Related Art

Nowadays, wireless communication devices, such as mobile phone handsets and portable computers, are becoming more and more popular. In order to communicate with one or more base stations, the wireless devices usually have to be equipped with an antenna. The characteristics of the antenna, such as radiation efficiency, orientation, and impedance bandwidth, bring influence on performance of the wireless device. Recently, wireless communication devices are becoming more compact and lightweight. Consequently, antennas, as key elements of wireless communication devices, are desired to be made ever smaller and space-saving. Therefore, a need exists in the industry.

SUMMARY OF THE INVENTION

In one aspect of the invention, an antenna device is disposed on a substrate, and includes a feed part, a holder, a body part, at least one ground plane, and a matching part. The feed part is for feeding electromagnetic signals. The body part for radiating and receiving the electromagnetic signals is electronically connected to the feed part. The body part includes at least two radiation parts electronically connected in sequence and surrounds at least two adjacent surfaces of the holder. The at least one ground plane for grounding is disposed on one side of the substrate. The matching part for impendence matching includes one end electronically connected to the body part and another end electronically connected to the ground plane. The ground plane surrounds two adjacent sides of the matching part.

Other advantages and novel features will become more apparent from the following detailed description when taken in conjunction with the accompanying drawings, in which:

DETAILED DESCRIPTION OF THE INVENTION

Figure 1:
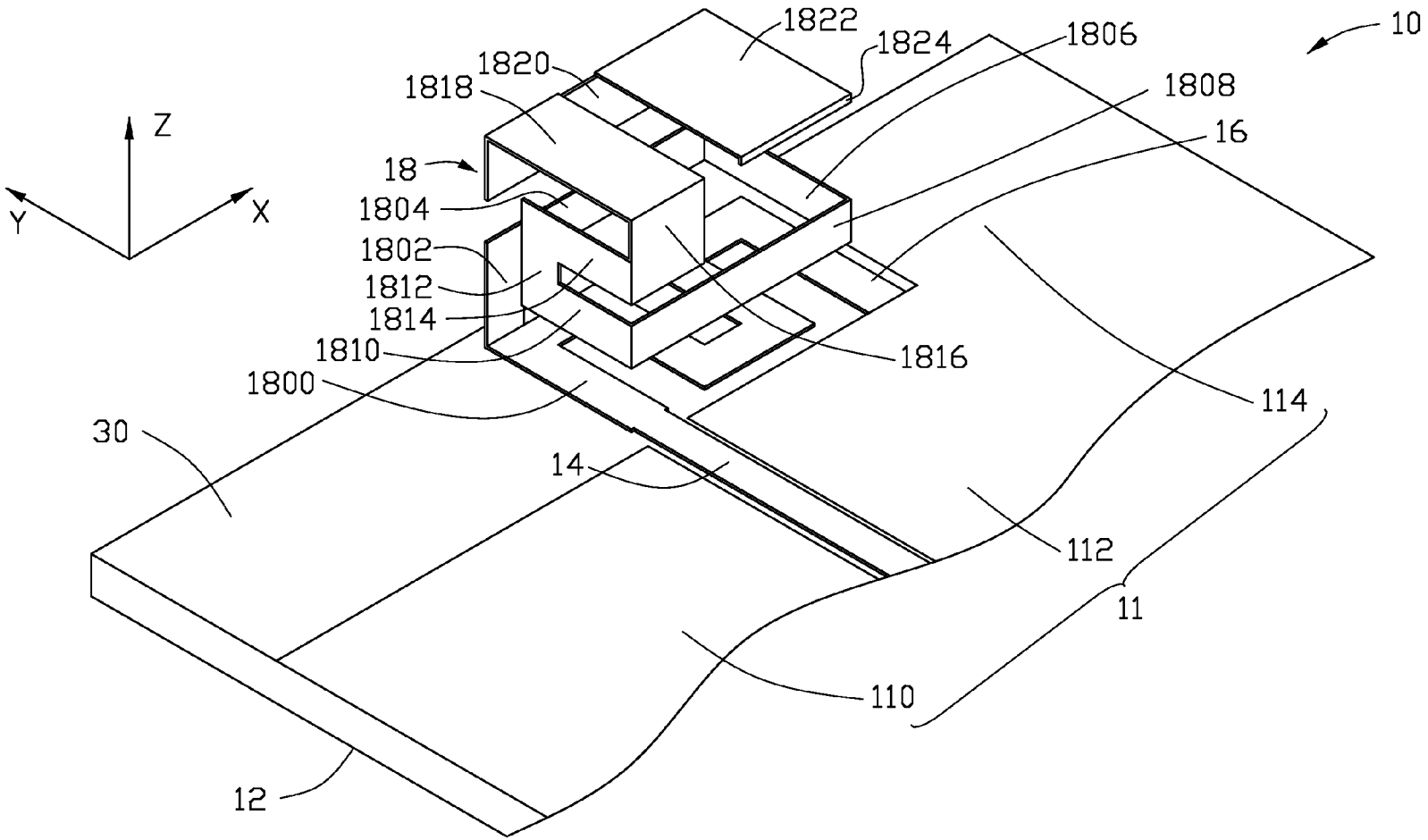
FIG. 1 is a schematic view of an antenna device according to an exemplary embodiment of the present invention.
Figure 2:
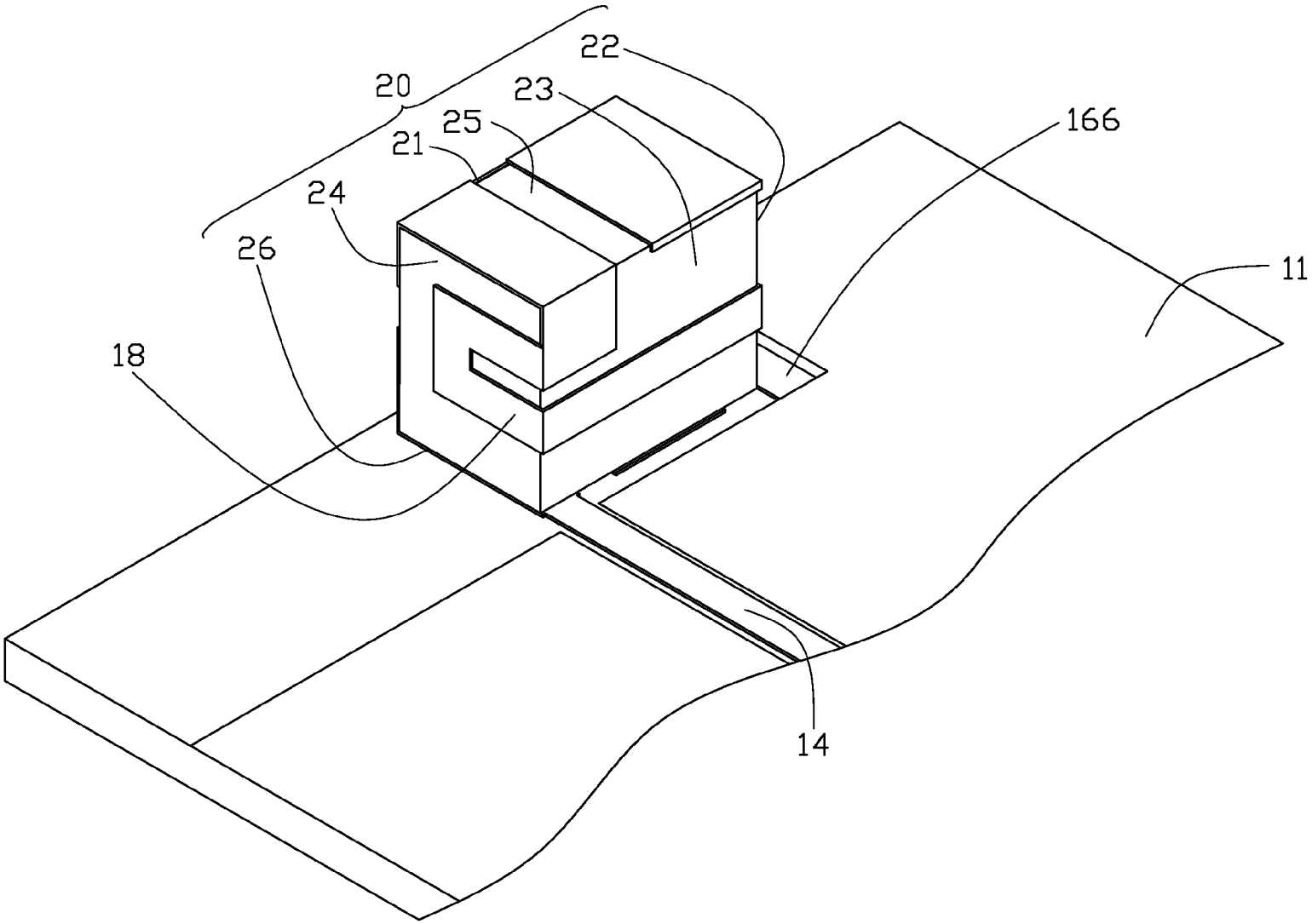
FIG. 2 is a schematic view of the antenna device of FIG. 1 disposed on a holder.

Referring to FIG. 1, an antenna device 10 according to an exemplary embodiment of the present invention is shown. Referring also to FIG. 2, the antenna device 10 of FIG. 1 is supported by surfaces of a hexahedron or a hexahedral holder 20. The antenna device 10 includes a first ground plane 11, a second ground plane 12, a feed part 14, a matching part 16, and a body part 18.

The feed part 14 for feeding electromagnetic signals and the matching part 16 for impedance matching are also disposed on a substrate 30. In the exemplary embodiment, a characteristic impedance of the feed part 14 is 50 ohms. The first ground plane 11 and the second ground plane 12 are disposed on two opposite surfaces of the substrate 30, and are used for grounding. The first ground plane 11 includes a first part 110, a second part 112, and a third part 114. In the exemplary embodiment, the first part 110, the second part 112, and the third part 114 are all substantially rectangular shaped. The first part 110 and the second part 112 are disposed at two opposite sides of the feed part 14. The third part 114 extends from the second part 112 to form an L-shaped ground plane, surrounding two adjacent sides of the matching part 16.

The body part 18 for radiating and receiving the electromagnetic signals, surrounds on at least two adjacent surfaces of the holder 20. In the exemplary embodiment, the holder 20 is substantially cubical shaped, includes six surfaces 21, 22, 23, 24, 25, 26, and the body part 18 surrounds on the six surfaces 21, 22, 23, 24, 25, 26. The sixth surface 26 covers at least one part of the matching part 16.

The body part 18 includes a first radiation part 1800, a second radiation part 1802, a third radiation part 1804, a fourth radiation part 1806, a fifth radiation part 1808, a sixth radiation part 1810, a seventh radiation part 1812, an eighth radiation part 1814, a ninth radiation part 1816, a tenth radiation part 1818, an eleventh radiation part 1820, a twelfth radiation part 1822, and a thirteenth radiation part 1824 electronically connected in sequence. In the exemplary embodiment, the above-mentioned radiation parts are all substantially rectangular strip shaped. The two adjacent radiation parts of the above-mentioned radiation parts 1800, 1802, 1804, 1806, 1808, 1810, 1812, 1814, 1816, 1818, 1820, 1822, 1824 are perpendicular to each other. Note that other embodiments do not limit the number of radiation parts, as long as at least two radiation parts are electronically connected in sequence and surrounding at least two adjacent surfaces of the holder 20.

The second radiation part 1802, the third radiation part 1804, and the eleventh radiation part 1820 are disposed on the first surface 21 of the holder 20. The second radiation part 1802 is electronically connected to and perpendicular to the third radiation part 1804, and the third radiation part 1804 is parallel to the eleventh radiation part 1820. The fourth radiation part 1806 is disposed on the second surface 22 of the holder 20.

The fifth radiation part 1808, the ninth radiation part 1816, and the thirteenth radiation part 1824 are disposed on the third surface 23 of the holder 20. The ninth radiation part 1816 and the thirteenth radiation part 1824 are respectively parallel to the fifth radiation part 1808, and the thirteenth radiation part 1824 has an open end. The sixth radiation part 1810, the seventh radiation part 1812, and the eighth radiation part 1814 are disposed on the fourth surface 24 of the holder 20. The seventh radiation part 1812 is electronically connected to and perpendicular to the sixth radiation part 1810 and the eighth radiation part 1814. The tenth radiation part 1818 and the twelfth radiation part 1822 are disposed on the fifth surface 25 of the holder 20. The tenth radiation part 1818 is parallel to the twelfth radiation part 1822.

In other exemplary embodiments, the body part 18 can include a plurality of radiation parts. For instance, when the holder 20 is substantially orbicular, the body part 18 is also substantially orbicular, and the radiation parts of the body part 18 are numerous.

Figure 3:
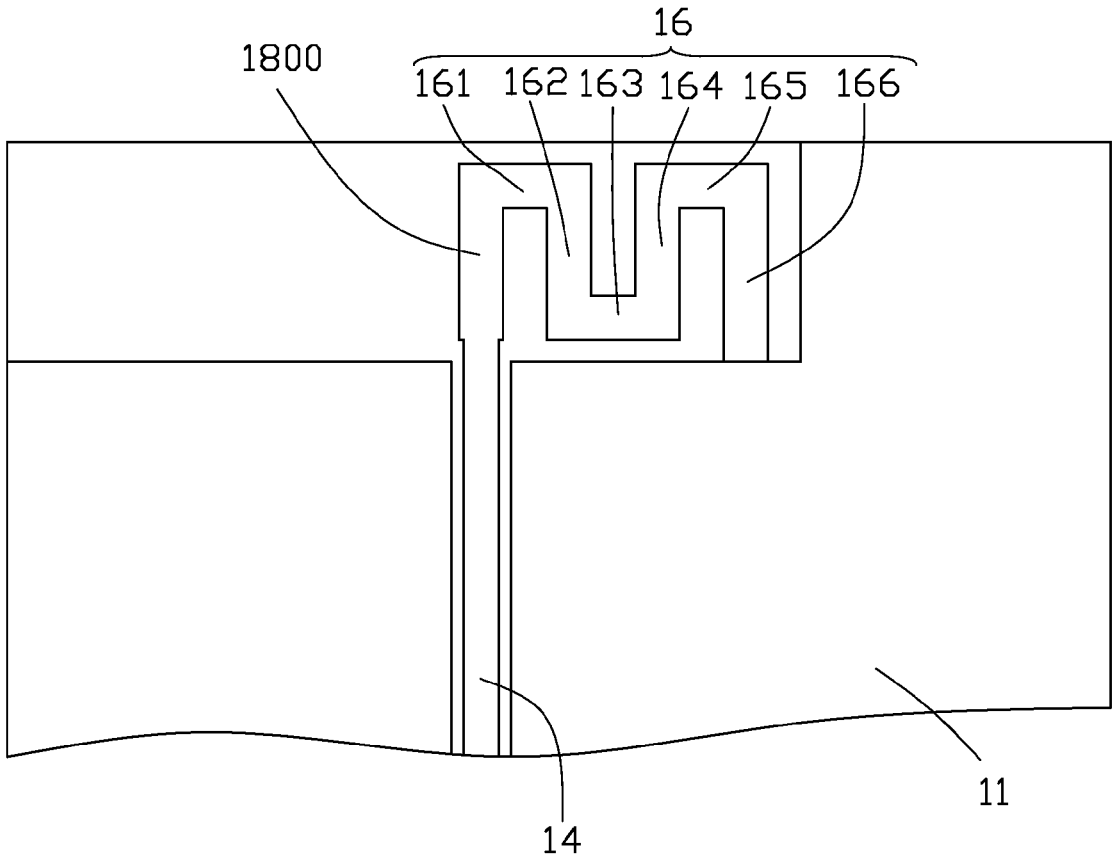
FIG. 3 is a schematic view of part elements of the antenna device of FIG. 1.

FIG. 3 is a schematic view of elements of the antenna device 10 of FIG. 1. The first radiation part 1800 is disposed on the substrate 30, and the sixth surface 26 of the holder 20

(shown in FIG. 2) covers the first radiation part 1800. The first radiation part 1800 has one end electronically connected to the feed part 14 and the other end electronically connected to the matching part 16. In the exemplary embodiment, the first radiation part 1800 and the matching part 16 are designed as printed elements, and the other radiation parts are made of metallic sheets.

One end of the matching part 16 is electronically connected to the first radiation part 1800 of the body part 18, and the other end of the matching part 16 is electronically connected to the first ground plane 11. The matching part 16 includes a first matching segment 161, a second matching segment 162, a third matching segment 163, a fourth matching segment 164, a fifth matching segment 165, and a sixth matching segment 166 electronically connected in sequence. In the exemplary embodiment, the above-mentioned matching segments are all substantially in rectangular strip shape. The two adjacent matching segments of the above-mentioned matching segments 161, 162, 163, 164, 165, 166 are perpendicular to each other.

The first matching segment 161 is electronically connected to and perpendicular to the first radiation part 1800 of the body part 18. The sixth matching segment 166 is electronically connected to the first ground plane 11. In the exemplary embodiment, the first matching segment 161 and the fifth matching segment 165 are configured in one line, and parallel to the third matching segment 163. The second matching segment 162 and the fourth matching segment 164 are parallel to the sixth matching segment 166. In the exemplary embodiment, the matching part 16 is designed as a printed element, which is electronically connected to the body part 18 made of metallic sheets.

At least one surface of the holder 20 covers at least one part of the matching part 16; that is, the body part 18 projects on a plane where the matching part 16 is located. In the exemplary embodiment, the sixth surface 26 of the holder 20 covers the first matching segment 161, the second matching segment 162, the third matching segment 163, the fourth matching segment 164, and the fifth matching segment 165.

In the exemplary embodiment, a length and a width of the first radiation part 1800 are respectively about 4 millimeters (mm) and 1 mm. A length and a width of the second radiation part 1802 are respectively about 1.5 mm and 1 mm. A length and a width of the third radiation part 1804 are respectively about 6 mm and 1 mm. A length and a width of the fourth radiation part 1806 are respectively about 4 mm and 1 mm. A length and a width of the fifth radiation part 1808 are respectively about 6 mm and 1 mm. A length and a width of the sixth radiation part 1810 are respectively about 3 mm and 1 mm. A length and a width of the seventh radiation part 1812 are respectively about 1.5 mm and 1 mm. A length and a width of the eighth radiation part 1814 are respectively about 2 mm and 1 mm. A length and a width of the ninth radiation part 1816 are respectively about 2 mm and 2 mm. A length and a width of the tenth radiation part 1818 are respectively about 4 mm and 2 mm. A length and a width of the eleventh radiation part 1820 are respectively about 6 mm and 1.5 mm. A length and a width of the twelfth radiation part 1822 are respectively about 4 mm and 3 mm. A length and a width of the thirteenth radiation part 1824 are respectively about 0.2 mm and 3 mm.

A length and a width of the first matching segment 161 are respectively about 2 mm and 1 mm. A length and a width of the second matching segment 162 are respectively about 3 mm and 1 mm. A length and a width of the third matching segment 163 are respectively about 2 mm and 1 mm. A length and a width of the fourth matching segment 164 are respectively about 3 mm and 1 mm. A length and a width of the fifth matching segment 165 are respectively about 1 mm and 1 mm. A length and a width of the sixth matching segment 166 are respectively about 4.5 mm and 1 mm. In other exemplary embodiments, the above lengths and widths of elements of the antenna device 10 can be changed.

Figure 4:
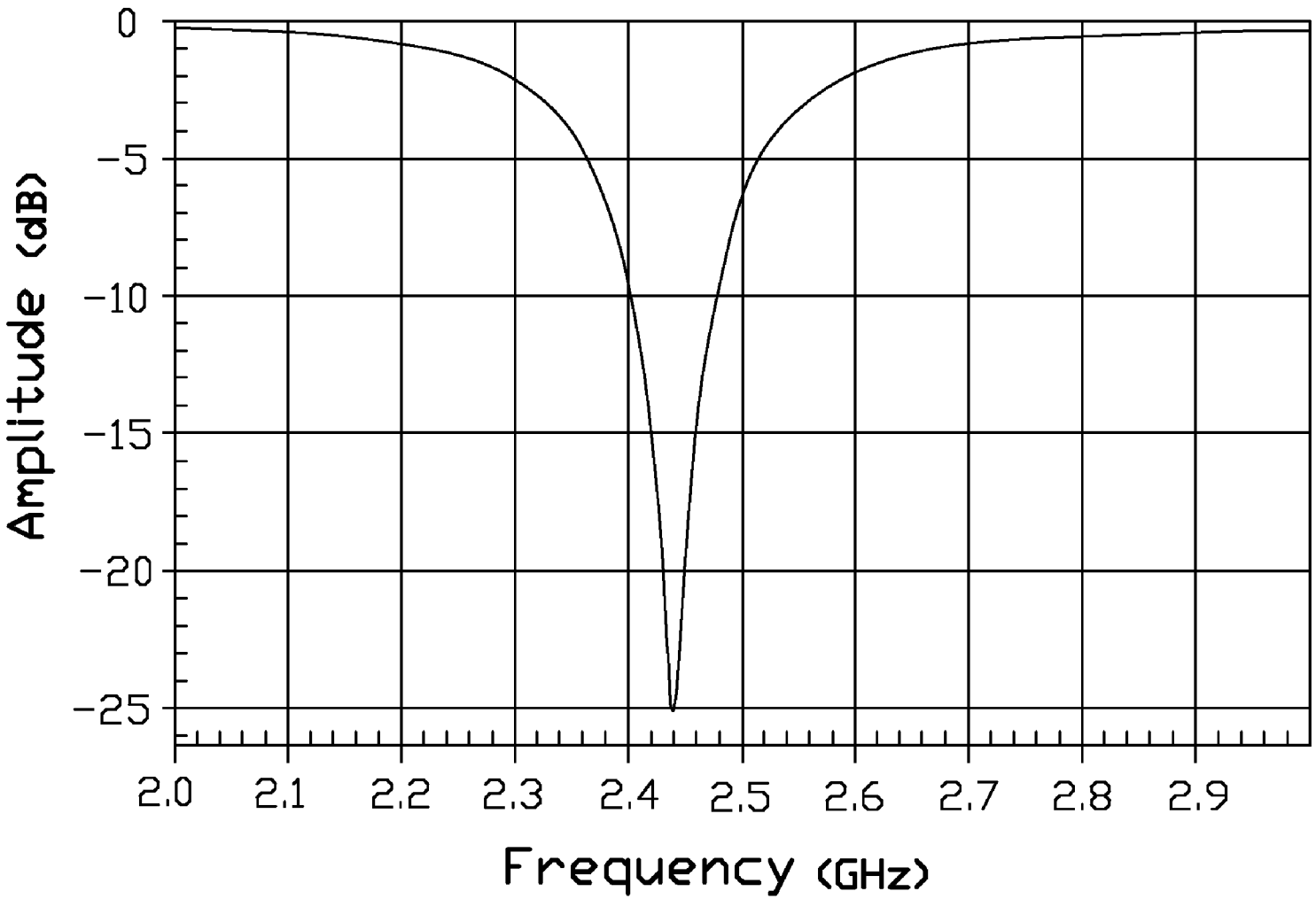
FIG. 4 is a graph of simulated test results showing reflection coefficient of the antenna device of FIG. 1.

FIG. 4 is a graph of simulated test results showing reflection coefficient of the antenna device of FIG. 1. As shown, when the antenna device 10 operates at working frequency bands of 2.4~2.5 GHz, its reflection coefficient is less than −6 dB, which is capable of meeting operating standards set forth in IEEE 802.11b.

Figure 5:
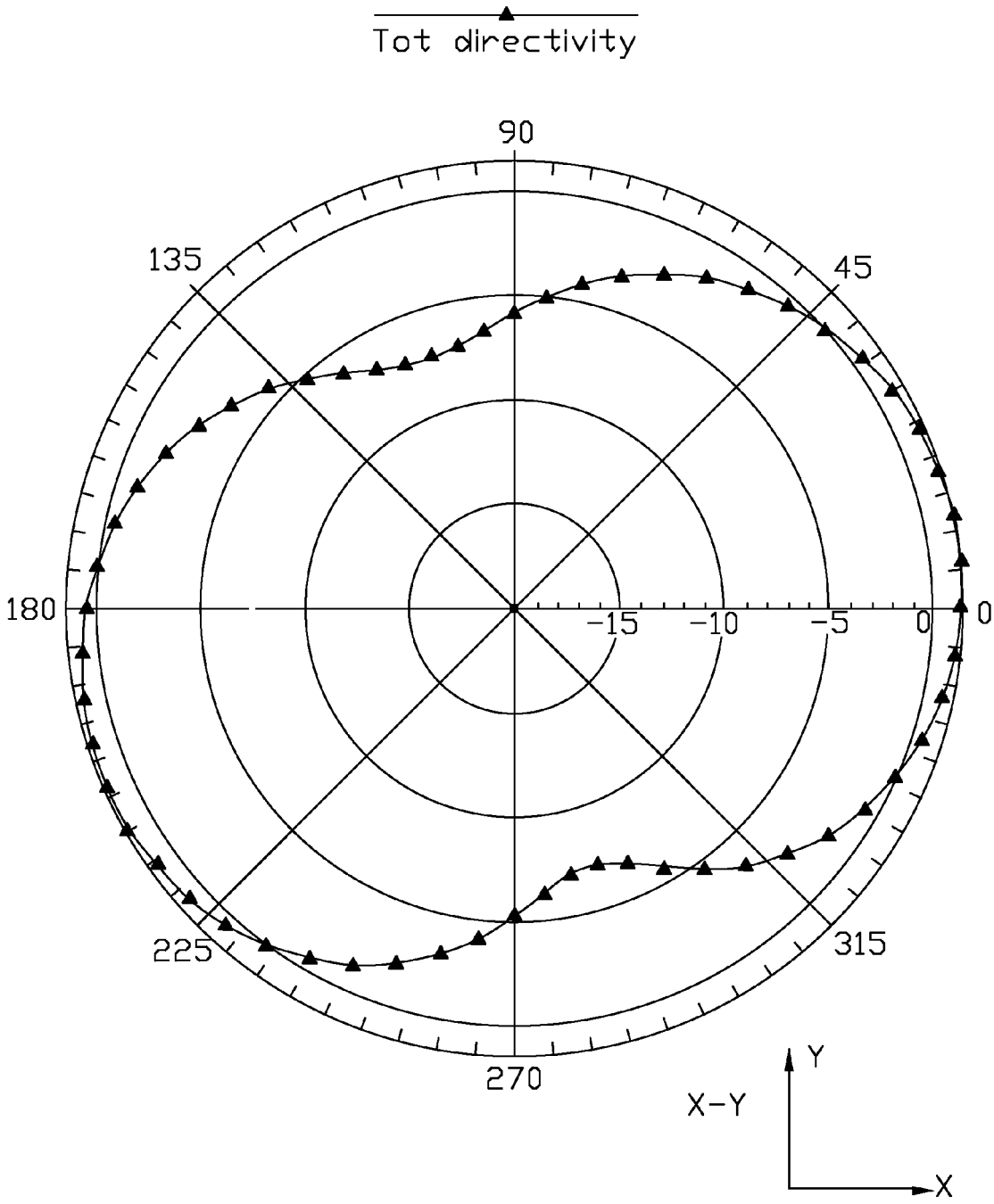
FIGS. 5-7 are graphs of simulated test results showing radiation patterns when the antenna device of FIG. 1 is operated at 2.44 GHz.
Figure 6:
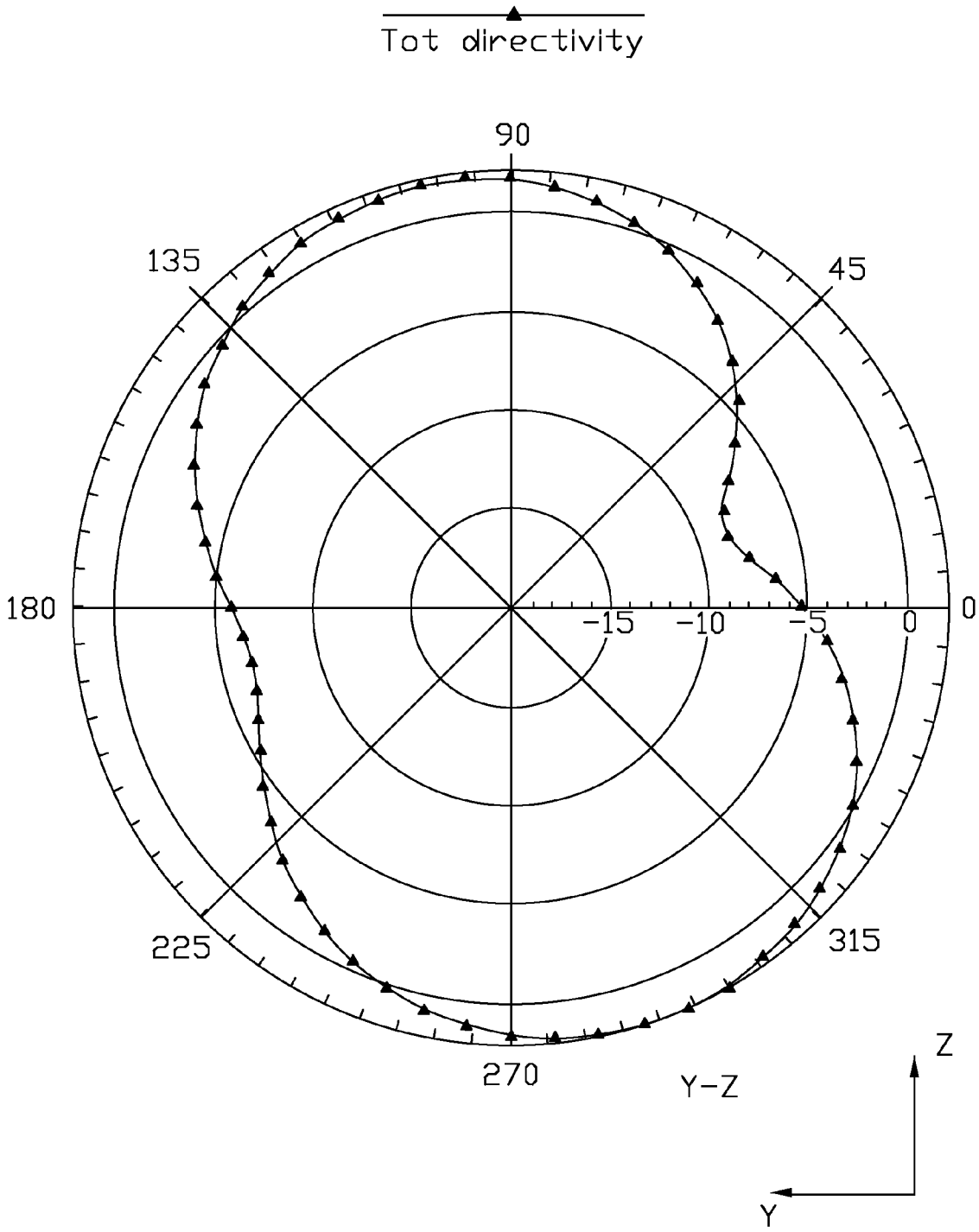
Figure 7:
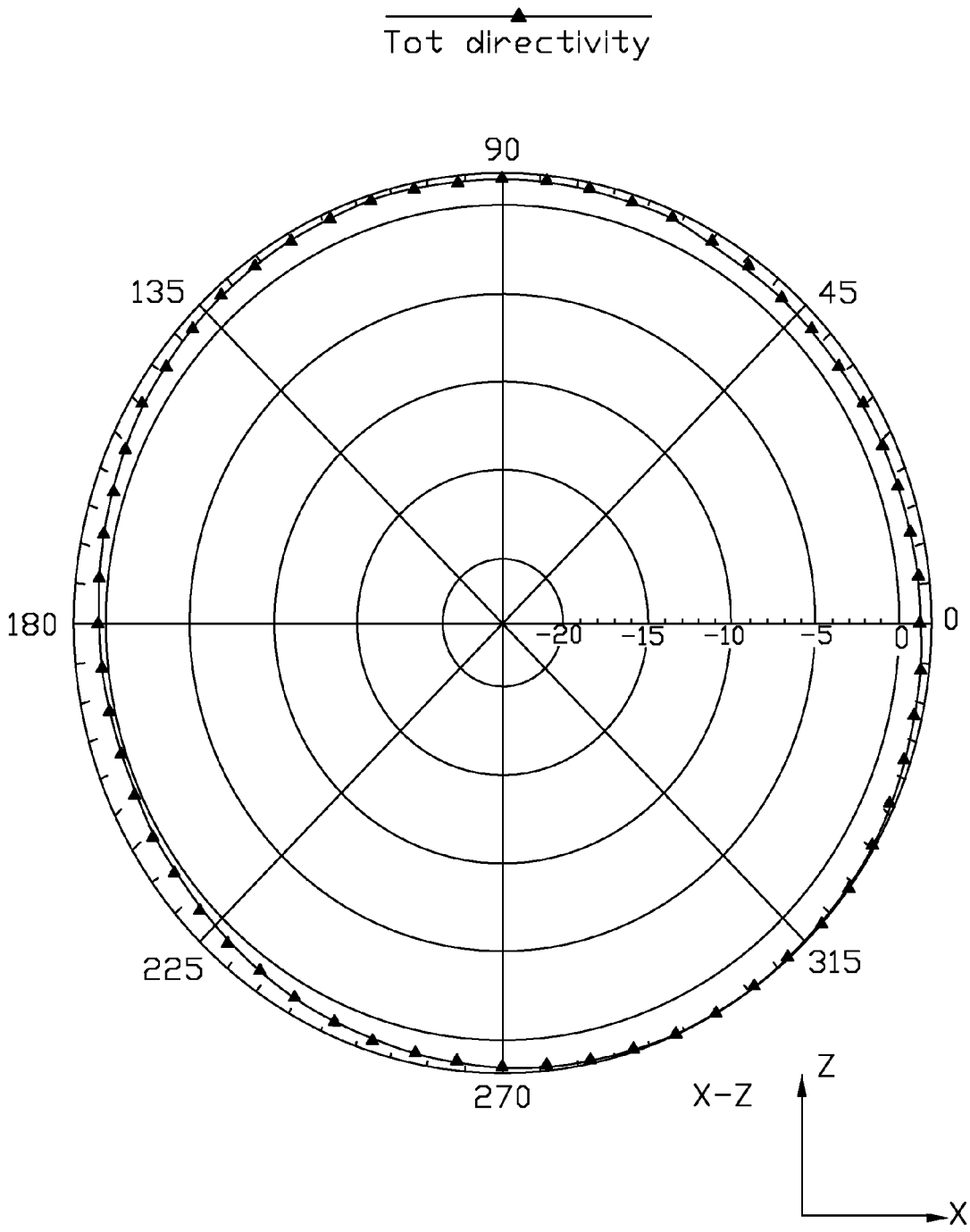

FIGS. 5-7 are graphs of simulated test results showing radiation patterns in horizontal and vertical planes when the antenna device 10 of FIG. 1 is operated at 2.44 GHz. It is to be noted that the radiation pattern is close to an omni-directional radiation pattern at X-Z plane when the antenna device 10 of the present invention is operated at 2.44 GHz.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. An antenna device, disposed on a substrate, comprising:

a feed part, for feeding electromagnetic signals;

a body part electronically connected to the feed part, for radiating and receiving the electromagnetic signals, comprising a plurality of radiation parts electronically connected in sequence and surrounding six surfaces of a holder;

at least one ground plane disposed on one surface of the substrate, for grounding; and a matching part, for impendence matching, comprising one end electronically connected to the body part, and another end electronically connected to the at least one ground plane;

wherein the at least one ground plane surrounds two adjacent sides of the matching part, and at least one surface of the holder covers at least one part of the matching part.

2. The antenna device of claim 1, further comprising another ground plane disposed on another surface of the substrate.

3. The antenna device of claim 1, wherein the feed part and the matching part are disposed on the same surface of the substrate.

4. The antenna device of claim 3, wherein the at least one ground plane and the matching part are disposed on the same surface of the substrate.

5. The antenna device of claim 4, wherein the at least one ground plane comprises a first part, a second part, and a third part, the first part and the second part are disposed at two opposite sides of the feed part, the third part extends from the second part, and the second part and the third part are surrounded at two adjacent sides of the matching part.

6. The antenna device of claim 5, wherein the third part extends from the second part to form an L-shape ground plane.

7. The antenna device of claim 1, wherein the body part projects on a plane where the matching part is located.

8. The antenna device of claim 1, wherein any two neighboring radiation parts are perpendicular to each other.

9. The antenna device of claim 1, wherein a first radiation part disposed on the substrate has one end electronically connected to the feed part and another end electronically connected to the matching part.

10. The antenna device of claim 9, wherein the surface covering the at least one part of the matching part covers the first radiation part.

11. The antenna device of claim 10, wherein the first radiation part and the matching part are designed as printed elements, and the other radiation parts are made of metallic sheets.

12. The antenna device of claim 1, wherein a last radiation part has an open end.

13. The antenna device of claim 1, wherein the matching part comprises a first matching segment, a second matching segment, a third matching segment, a fourth matching segment, a fifth matching segment, and a sixth matching segment, and electronically connected in sequence.

14. The antenna device of claim 13, wherein any two adjacent matching segments are perpendicular to each other.

15. The antenna device of claim 1, wherein the matching part is designed as a printed element, and the body part is made of metallic sheets.

16. An assembly comprising:

a substrate; and an antenna device disposed on said substrate and comprising a feed part electrically connectable with said substrate for feeding electromagnetic signals, said antenna device further comprising a body part electrically connectable with said feed part for radiating and receiving said electromagnetic signals, said body part comprising a plurality of different radiation parts electronically connected in sequence and defined to extend for surrounding six surfaces of a three dimensional space neighboring said feed part and said substrate.

17. An assembly comprising:

a substrate; and an antenna device disposed on said substrate and comprising a feed part electrically connectable with said substrate for feeding electromagnetic signals, said antenna device further comprising a body part electrically connectable with said feed part for radiating and receiving said electromagnetic signals, said body part comprising a plurality of radiation parts electronically connected in sequence and defined to extend along six surfaces of a predefined hexahedron defined to be located beside said substrate.

* * * * *